United States Patent [19]

Smith, II

[11] Patent Number: 4,498,591

[45] Date of Patent: Feb. 12, 1985

[54] OPENABLE FLEXIBLE PACKET

[75] Inventor: George B. Smith, II, Portland, Me.

[73] Assignee: Drug Concentrates, Inc., Annandale, N.J.

[21] Appl. No.: 198,544

[22] Filed: Oct. 20, 1980

Related U.S. Application Data

[60] Division of Ser. No. 845,472, Oct. 26, 1977, Pat. No. 4,261,253, which is a continuation-in-part of Ser. No. 362,741, May 22, 1973, abandoned.

[51] Int. Cl.[3] ..... B65D 27/32

[52] U.S. Cl. ..... 206/620; 383/35; 383/906; 493/918; 493/930; 493/934

[58] Field of Search ..... 206/491, 620, 484; 229/17 R; 493/242, 240, 930, 934, 918; 383/35, 906

[56] References Cited

U.S. PATENT DOCUMENTS

| | | | |
|---|---|---|---|
| 1,980,953 | 11/1934 | Kilmer | 383/35 X |
| 2,176,912 | 10/1939 | Luckett | 229/17 R |
| 2,268,283 | 12/1941 | Harris et al. | 493/252 |
| 2,341,056 | 2/1944 | Moore | 206/491 X |
| 3,129,815 | 4/1964 | Baxter | 206/620 |

FOREIGN PATENT DOCUMENTS

| | | | |
|---|---|---|---|
| 461 | of 1900 | United Kingdom | 383/35 |

*Primary Examiner*—James F. Coan

*Attorney, Agent, or Firm*—Dan, Dorfman, Herrell and Skillman

[57] ABSTRACT

A thin flexible pouch-packet is disclosed which has concave deformations in the side wall to enhance opening of the packet.

6 Claims, 10 Drawing Figures

OPENABLE FLEXIBLE PACKET

This application is a division of application Ser. No. 845,472, filed Oct. 26, 1977, now U.S. Pat. No. 4,261,253, which application is a continuation-in-part of copending application Ser. No. 362,741 filed May 22, 1973 and now abandoned.

This invention is that of a relatively thin, flexible, generally flat, rectangular pouch-packet having generally flat substantially parallel opposed rectangular walls completely joined together around their peripheral edges with two opposed pairs of edges (called the top and bottom pairs) and one of the intermediate pairs closed by heat sealing and the remaining pair being closed by either a heat seal or a fold. The packet thereby is substantially hermetically sealed. It includes the shortly below mentioned improvement.

Substantially parallel to the heat sealed top edge, and spaced away but in relatively close proximity to its sealed area, is a weakened tearing line serving to facilitate tearing off the thereby delineated marginal strip to enable opening the packet to serve as a cup. Such flexible, pouch-packets often contain a relatively finely divided composition readily soluble or stably dispersible in water when added to the opened pouch-packet to provide a tasty beverage (of different types) or a mouthwash or gargle, or a medicament.

The packet of this invention includes an improvement that enables opening it into cup-like shape merely by applying pressure against the two opposed parallel closed sides toward one another.

Such packets ordinarily are prepared from a paper web of pouch stock (such as from 25 to 60 pounds per ream of 24 inches by 36 inches) usually laminated and including a heat-sealed coating, preferably of polyethylene. These pouch-packets are said to be relatively thin by their having an overall thickness of from about 3.5 to about 6 mils.

Quite often, and depending on the properties of the planned finely divided composition content for the packet, these pouch-packets are prepared from a laminated web having for its inner layer a sealing coat of polyethylene laid entirely over a relatively thin aluminum foil layer (as thin as about 0.35 mil) joined by an intervening coat of polyethylene to an outer paper layer adapted to take any desired printed matter.

More often than not the user of such packet, after tearing off the opening strip, generally is inclined to seek to open the packet into cup-like shape, by inserting one or more of his fingers between its opposing walls to spread them apart.

However, for cleanliness and sanitary purposes and especially when its contents is a mouthwash or gargle or medication of some kind, the packet must be opened into cup-like shape without inserting any fingers between the opposing walls. Unfortunately, that has been found to be relatively difficult because usually, and especially when the contents of the packet is small so that the opposed walls of the packet are not well separated by bulky content, application of pressure against the opposed parallel closed sides of the packet instead of separating the walls bends both of them in the same direction. Thereby they remain in such close contact that eliminates the possibility of opening the pouch without having to use any fingers.

That disadvantage is overcome in the flexible pouch-packet of this invention by producing, beneficially in each of its walls in such location where the wall has a tendency to bend in the wrong direction when pressure is applied to the opposed closed sides of the packet, a narrow elongated, ribbon-like deformation that provides at said location a reduced resistance to bending in the right direction. Thereby finger pressure applied to the two opposed parallel closed ends to force them toward one another causes each so deformed wall readily to bend outwardly away from the other one so that the two walls separate from one another and provide the desired cup-like shape.

Advantageously, this deformation can be an elongated, narrow embossment in the packet wall and concave from the inside and thus convex as viewed from the exterior. It can start at the line of perforations at a point intermediate its ends and about midway between the inside of the opposed parallel closed sides. From that starting point the embossment (as the deformation) can extend in a straight line inwardly at least midway, and beyond that, toward what is to be the bottom of the cup.

Advantageously, before extending to midway toward the bottom of the cup the straight line embossment can be forked to become Y-shaped with the diverging arms extending toward and approaching near to its bottom corners. The embossment also may have some other shape starting from the line of perforations, such as V-shaped with its apex location about midway along the line of perforations and its diverging arms likewise extending toward and approaching near the bottom corners of the inside of the packet.

Instead of as an embossment, the deformation may take the form of a correspondingly located scoring line on the outside surface of the paper layer of the packet, also either as a straight line alone or Y-shaped or V-shaped extending from the outer surface part way through the thickness of the wall to an extent sufficient only to permit the finger pressure opening of the cup to occur and to avoid (i) tearing of the cup in handling and (ii) impairing its ability to retain its contents. With the packets which include the aluminum foil paper in laminated walls, such scoring, if necessary, may be as deep as the thickness of the outer paper layer.

Considered broadly the product of the invention is a relatively thin, flexible, generally flat packet (a) containing a finely divided material enclosed between generally flat substantially parallel opposed rectangular walls completely closed around their entire periphery as by being marginally sealed together at what are designated respectively as the top and bottom of the packet and on one of the sides and being integrally continuous with one another at the remaining side, (b) having substantially parallel to its top outer edge and inwardly spaced away from, but in relatively closed proximity to its top marginal seal across each wall, a weakened tearing line penetrating the outer surface of the wall to an extent sufficient to enable a subsequent tearing off of the marginal opening strip between that line and the top edge of the packet but insufficient to puncture said wall or destroy its resistance to moisture penetration; and (c) extending from about said line of perforations at a point intermediate its ends and generally about midway between the inside of sealing strips of the opposed parallel closed sides and extending at least midway, and better beyond that, toward the bottom end of the packet a narrow, elongated, ribbon-like walls-separating-enhancing deformation that provides along its indicated line in the wall a reduced resistance to bending away from the other one when the opening strip is torn off and pressure is applied to the opposed closed sides to urge them toward one another.

In separate specific embodiments the tearing line can be a continuous, or a consecutively intermittently interrupted, scoring line or beneficially a line of shallow closely separated round or advantageously dash-shaped perforations puncturing the walls outer surface to the extent earlier above described.

In still further separate specific embodiments, particularly when the finely divided content is deleteriously affected by moisture and/or air, it is advantageous that the walls of the packet be laminated, for example, made up of four different layers such as those earlier above described. In such case the top and bottom and the one side of the packet can be safely sealed by heat-sealing them along the three borders of the contacting inner layers of polyethylene. Also, with these laminated walls, the scoring and either of the forms of perforations for the tearing line and for the scoring form of the deformation may be made through the thickness of the outer paper layer.

The invention includes also the method of producing the walls-separating-enhancing deformation constituting the improvement in the pouch-packets of this invention over the pouch-packets of U.S. Pat. No. 3,431,847.

The pouch-packet of the invention is more fully explained in relation to the accompanying drawings including an illustrative embodiment of it, wherein.

Figure 1:
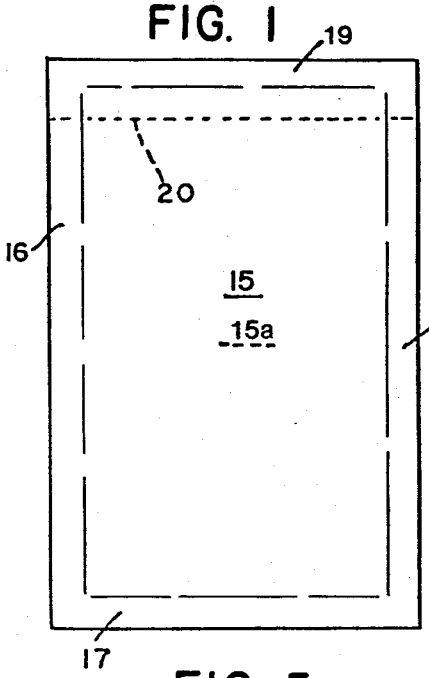
FIG. 1 is a plan view of one form of flexible pouch-packet (heat sealed on all four sides) used prior to the invention herein.

FIG. 1 shows one form of the relatively thin, flexible, generally flat pouch-packets preceding the instant invention. That earlier form consisted of two rectangular flat sheets 15 and 15*a* (the latter not shown) of flexible pouch-packet stock completely closed on all four sides by heat sealed margins 16, 17, 18 and 19. A line of perforations 20 near the top of each sheet shortly spaced downwardly away from the sealed margin 19 allowed for tearing away an opening strip to provide access to the interior of the packet.

Figure 2:
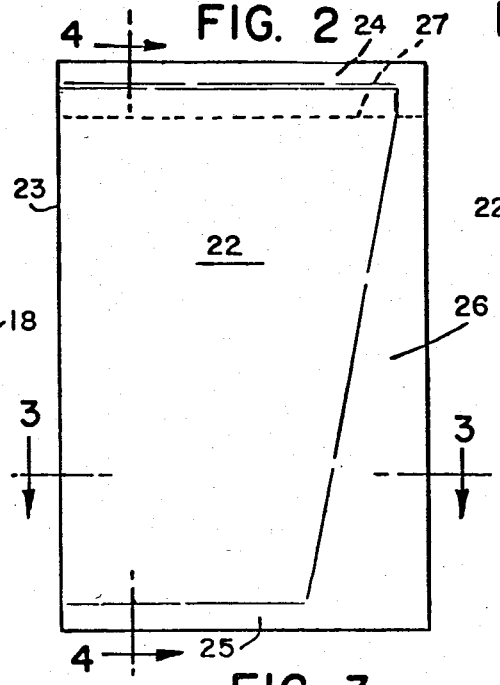
FIG. 2 is a plan view of another prior art flexible pouch-packet with a fold instead of a heat seal on its left side and the width of the heat seal on the right of the packet increased from the top to the bottom of the packet for the right triangular form of that heat seal to serve as a handle after the top strip is torn away for the packet then to be opened to serve as a cup.

The prior art packet of FIG. 2 consisted of a larger single sheet 22 of flexible pouch-packet stock folded over on itself in two equal overlapping parts at the fold 23 with a marginal heat seal 24 at the top and 25 at the bottom and a substantially right triangular heat seal 26 on the right-hand side to serve as a handle 26 when the closing strip was torn away along the tear line of perforations 27.

Figure 6:
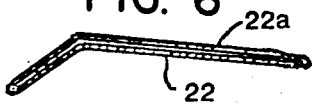
FIG. 6 is a horizontally transverse section of the packet of FIG. 2 after its opening strip was torn away, illustrating how both walls of the packet bend in the same direction when pressure is applied to the opposed parallel closed sides of the prior art packet to try to open it.

After tearing away the opening strip from the prior art packet of FIG. 1 and supporting its bottom on the small fingers of both hands and engaging the outer vertical edges of the seal margins 16 and 18 by the respective index fingers of both hands and applying pressure on these seal margins and thus urging them together in trying to open the cup section of the packet without inserting a finger between its opposing walls, often both of the opposing walls 15 and 15*a* (FIG. 6) bent in the same direction, namely, convexly outwardly from an imaginary horizontal line extending through the outer ends of the marginal heat seals 16 and 18.

In attempting likewise to spread the walls 22 and 22*a* of the prior art packet of FIG. 2 to convert them into an open cup, instead both of these opposing walls often also would bend in the same direction as occurred with the walls 15 and 15*a* of the packet of FIG. 1.

Corresponding two embodiments of the improved readily openable packet of the invention are illustrated by the packets of each of FIGS. 1 and 2, modified for example, by deforming each of their opposing walls by including in each wall a walls-separating-enhancing deformation starting at least at the line of perforations (that enables tearing away the opening strip) and extending from a point on it about midway between the inner edges of the sealing strip margins 16 and 18 (as in FIG. 1) and the fold 23 and the sealing margin 26 (as in FIG. 2) and extending downwardly to below the middle to, or shortly spaced away from, the bottom marginal seal 17 and 25 respectively.

The statement that the deformation starts "at" the tearing line (of perforations) to facilitate tearing off the closing strip, intends that the deformation may start anywhere across the width of the tearing strip as well as slightly inwardly (i.e. downwardly) away from it on what is to remain as the wall of the cup.

Also, the statement that the deformation is to start at a "location about midway between the inner edges of the closure of the two opposed parallel sides of the pouch-packet" embraces its starting at a location in the range of (i) from midway between those inner edges as in the case of a pouch-packet which is heat sealed along all four of its sides (e.g. as that in FIG. 1 but including the walls-separating-enhancing deformation part of the invention), (ii) to a point about two-thirds of the distance from the handle side as in the case of the pouch-packets of the invention which have a broader heat seal on one side to serve as a handle, e.g. as the handle seen in FIG. 2.

Figure 4:
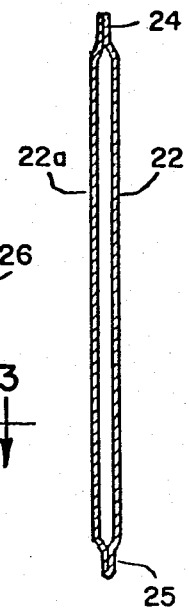
FIG. 4 is a vertically transverse section through the pouch packet of FIG. 2 along the line 4—4.

Such packets of FIGS. 1 and 2, each modified to include the walls-separating-enhancing deformation part of the invention, such as an embossment, appear in a vertical cross section outside of the range of the embossment and spaced inwardly away from the closed left-hand side of the packet, just like that of FIG. 4.

Figure 7:
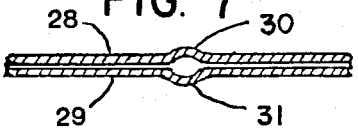
FIG. 7 is an enlarged fragmentary horizontally transverse section, e.g. at the elevation of the line 7—7 of FIG. 8, through a packet of the invention with an embossed deformation.
Figure 8:
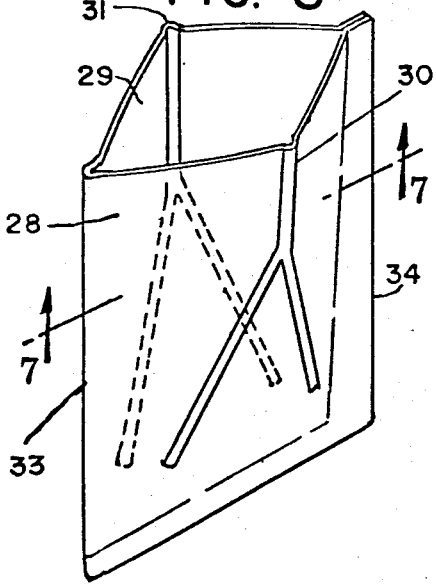
FIG. 8 is an isometric view of a packet like that of FIG. 2 but including an embossed embodiment of the deformation feature of this invention in the form of an outwardly convex inverted Y in each wall of the packet.

A fragmentary horizontally transverse cross section of the packets of FIGS. 1 and 2, as modified to include the walls-separating-enhancing deformation of the invention, taken in the so modified FIGS. 1 and 2 at an elevation in them corresponding to that of the line 7—7 shown in FIG. 8 appears as shown in FIG. 7. FIG. 7 shows in each of the opposed parallel walls 28 and 29 of the packet of the invention its respective embossed deformation 30 and 31.

Then, after tearing away the opening strip of the resiliently flexible, generally flat pouch-packet of the invention (as in the just earlier above described packet of FIG. 2 modified to include the deformation provided by the invention), and applying pressure against the outer edges of the opposed parallel vertical sides 33 and 34 (FIG. 8) and toward one another results in separating the walls 28 and 29 of the pouch-packet to present it in its open cup-like form as seen in FIG. 8, and without any need to insert any finger between the top edges of the opposed walls.

Figure 5:
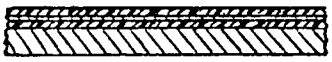
FIG. 5 is an enlarged fragmentary section through one wall of the section in either of FIGS. 3 and 4, showing the separate layers of the materials constituting the laminate form of flexible pouch-packet.
Figure 3:
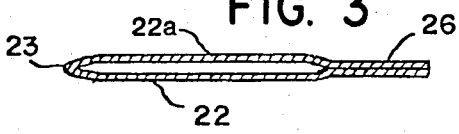
FIG. 3 is a horizontally transverse section through the line 3—3 of FIG. 2.

The several different variations that can occur in the constitution of the opposing walls of the packets of the invention depending, for example, on whether the wall consists of solely the paper layer coated with a layer of a heat-sealing polymer such as polyethylene or is more extensively laminated as in the wall composition shown in FIG. 5, and the differences in the applicable papers and in the polymers and the thickness of the respective individual layers, make it difficult to state a specific depth for the deformation.

Its depth also would vary with differences in its width transverse to its length. In some cases, as with a wall consisting of just the paper layer with merely a single adhering layer of polyethylene, an embossed deformation of as little as 2 mils in depth may be sufficient. In other cases, as in the laminate of FIG. 5 the embossed deformation might well need to be 4 mils deep and perhaps better 5 mils deep if it were narrower in width.

As part of a specific example, in the laminate of FIG. 5 the outer paper layer (lowest in FIG. 5) can be 4 mils thick, the aluminum foil layer can be 0.35 mil thick, the intermediate laminating coat polyethylene (low density) layer can be 0.5 mil (6 lbs./1,000 sq. feet) thick, and the inner sealing coat polyethylene (also low density) layer (topmost in FIG. 5) can be 0.7 mil (10 lbs./1,000 sq. feet).

A laminated web whose separate layers have these several respective thicknesses in useful in a specific embodiment as for a flexible pouch-packet 1.75 inches high (including the sealing strip) by 2.75 inches wide. However, the selection of the respective layers and their thickness for any particular laminated wall can vary depending on the extent to which impermeability to air and/or moisture is needed for the particular characteristics of the finely divided material to be enclosed in the packet.

How the embossed type of deformation is provided in the walls of a packet of the invention conveniently is described with the aid of referring to the George B. Smith and Robert A. Vested U.S. Pat. No. 3,431,847. Reference to its FIGS. 1 and 5 and its column 2 (last pgh.), its column 3 lines 14 to 17, column 4 lines 16 to 39 and column 7 line 39 to column 8 line 6 shows that over the outer surface of the paper of a laminated web is printed a number of side by side series, each having an extensive number of consecutive imprints of what is to appear printed on the edge to edge connected front and rear walls of the individual finished packets, and that they are all rolled up together in a single wide roll.

Column 7 line 39 to column 8 line 6 of that patent shows that (i) the finished printed wide roll of the web is then slit (column 7 lines 54 to 65) into a number of separate narrow rolls, each single roll as wide as what is to be the side by side width of both walls of a single packet; and (ii) then each of these rolls (column 7 lines 60 to 65) "separately is unwound as it is run over a folding plow, advantageously as a station of the packaging machine, to fold the two . . . halves of each block unit back to back along line H-I"(of that patent FIGS. 1 and 5).

Figure 10:
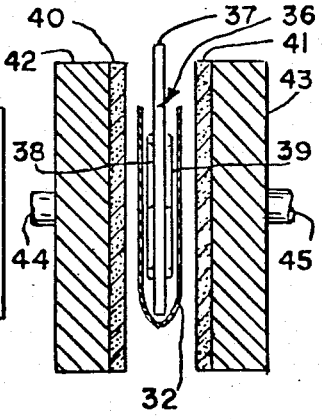
FIG. 10 is a fragmentary vertically transverse section showing the die of FIG. 9 inserted in the folded over web (from which a series of individual packets is prepared) and as interposed between the opposed members of a pair of platens which serve to press each separate wall of the folded web against its respective face of the embossment-forming die.

The embossed deformation part of this invention is produced, for example (as shown in FIG. 10 hereof), on the thus folded web 35 at a station (conveniently called the deformation or embossing station) next after the folding plow station in the packaging machine.

Figure 9:
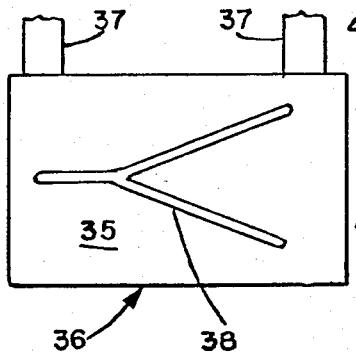
FIG. 9 is a fragmentary view of one side of the support-carried die, showing the position of the die for the operation of producing the deformation of this invention.

FIG. 9 hereof shows the front embossing face 35 of a double faced die 36 carried on stationary arms 37 depending from a suitable bracket (not shown) in the packaging machine. Each embossing face 35 of embossing die 36 carries its protruding embossing member 38 and 39 (in this case as the letter Y turned 90° clockwise so as to appear in the upside-down position in the finished packet as seen in FIG. 8).

On leaving the folding plow position of the packing machine, the folded web straddles the stationary double faced die 36 and is stopped in such position relative to the printed matter for the two joined respective walls 28 and 29 (of what is to be the finished flexible pouch-packet) that the outer end of the leg of the Y-shaped embossing member 38 and 39 will be at least at or crossing the tearing line of perforations.

At the embossing position each side of web 36 is in spaced away relationship sandwiched between one face of embossing die 36 and its adjacent (presently considered beneficial) resiliently firm silicone rubber platen 40 and 41 each supported on its respective pressure base 42 and 43 on its respective pressure arm 44 and 45.

While the laminated web is stationary at the deformation station of the packaging machine, it is thus sandwiched between the die faces 35 and the platens 40 and 41. Pressure means (not shown) operatively connected to arms 44 and 45 impel bases 42 and 43 and thus platen 40 and 41 against embossing members 38 and 39 with sufficient pressure, while at the same time die 36 is heated by heating means (not shown) to bring the embossing members to a temperature in the range from about 130° to 180° F., and beneficially 140° to 165° F., to impress and set in the web the desired deforming embossment.

The pressure then is removed to release the web from the die and allow the web to be moved to place the next packet imprint in position between the die faces and the platens for the next embossing operating.

If it is desired to use the scoring form of walls-separating-enhancing deformation, that can be provided, for example, by replacing the die-carrying faces 35 by flat plates on which can be affixed a suitable length of perforating-teeth-bearing strips of the type illustrated in FIG. 4 of the aforesaid U.S. Pat. No. 3,431,847, and as identified in its column 3 lines 11–13 and described in its column 5 lines 29 to 31 and 67 to 71, and all of its column 6, that the scoring does not vitiate the needed resistance to air and/or moisture in the wall of the finished product or weaken the strength of the web against its satisfactorily holding up in the handling of it through the packaging machine.

The width of the deformation, as by embossing, generally need not exceed and often not need be as much as 4 millimeters.

The deformation is said to be ribbon-like because it is narrow or slender in width. That applies to the deformation whether it is done in a single line or branched as inverted Y- or V-shaped.

The ability of the flexible pouch-packet of the invention to open to cup-like form, after the opening strip is torn off, and solely by applying pressure to the opposed sides of the walls of the packet by the fingers of the user or a nurse or attendant is a great advantage in avoiding contamination especially in use of these pouch-packets in such places as hospitals, nursing homes, clinics and physicians offices, for example, for dispensing dry forms of mouthwashes or gargles, or repeated fixed doses of medications, each to be dissolved by addition of water (or other solvent).

That the pouch-packet of the invention is flexible shows that it can be bent over without cracking, breaking or being permanently deformed.

While the invention has been explained by detailed description of certain specific embodiments of it, it is understood that varous modifications and/or substitutions may be made in any of them within the scope of the appended claims which are intended also to cover equivalents of the described embodiments.

What is claimed is:

1. A thin, flexible, generally flat and rectangular pouch packet containing a finely-divided material therein, comprising a pair of generally flat substantially parallel opposed fluid-impervious rectangular walls having inside surfaces in generally face to face confrontation with the walls completely joined together around their peripheral top, bottom, and side edges and having a weakened tearing line substantially parallel with and in close proximity to be joined top edge of the packet defining a tear away marginal strip to facilitate the opening of the pouch packet to cup-like form, at least one of the walls having a thin elongated embossment providing a concave deformation relative to the inside surface of the wall, the concave deformation protruding outwardly from the generally flat inside surface of the wall to provide a channel between the inside surfaces of the opposing walls disposed in the generally face to face confrontation, the concave deformation starting at the tearing line at a position midway between joined inner side edges of the pouch packet and extending toward the bottom edge of the pouch packet and being dimensioned and arranged to facilitate folding of said wall outwardly to enable the packet to open into generally cup-like form upon the removal of the tear-away marginal strip and the application of pressure urging the side edges of the packet toward one another, whereby fluid may be added to the finely-divided material in said packet while in its generally cup-like form.

2. The pouch packet in accordance with claim 1 wherein the embossment is bifurcated with arms diverging toward the respective outer ends of the bottom edge of the packet.

3. The pouch packet in accordance with the claim 1 wherein the embossment is Y-shaped with its arms diverging toward the respective outer ends of the bottom edge of the packet and with its leg starting at said tearing line.

4. A thin, flexible, generally flat and rectangular pouch packet comprising a pair of generally flat substantially parallel opposed rectangular fluid-impervious walls having inside surfaces in generally face to face confrontation with the walls completely joined together around their peripheral top, bottom, and side edges and having a weakened tearing line substantially parallel with and in close proximity to be joined top edge of the packet defining a tear away marginal strip to facilitate the opening of the pouch packet to cup-like form, with both walls having a thin elongated embossment providing a concave deformation relative to the inside surface of each wall, each concave deformation protruding outwardly from the generally flat inside surface of the respective wall to provide a channel between the inside surfaces of the opposing walls disposed in the generally face to face confrontation, each concave deformation starting at the tearing line and at a position midway between joined inner side edges of the pouch packet and extending toward the bottom edge of the pouch packet, said embossment being dimensioned and arranged to facilitate folding of said wall outwardly to enable the packet to open into generally cup-like form upon the removal of the tear-away marginal strip and the application of pressure urging the side edges of the packet toward one another.

5. The pouch packet in accordance with claim 4 wherein the embossment is bifurcated with arms diverging toward the respective outer ends of the bottom edge of the packet.

6. The pouch packet in accordance with claim 4 wherein the embossment is Y-shaped with its arms diverging toward the respective outer ends of the bottom edge of the packet and with its leg starting at said marginal strip.

* * * * *